United States Patent [19]

Johnson

[11] Patent Number: 4,872,303

[45] Date of Patent: Oct. 10, 1989

[54] BAG TOP FORMING METHOD AND APPARATUS

[75] Inventor: Harold K. Johnson, Junction City, Kans.

[73] Assignee: Mid America Machine Corp., Junction City, Kans.

[21] Appl. No.: 159,276

[22] Filed: Feb. 25, 1988

[51] Int. Cl.[4] ..... B65B 51/00; B65B 7/06

[52] U.S. Cl. ..... 53/481; 53/371

[58] Field of Search ..... 53/481, 371, 372, 373, 53/378, 480, 76

[56] References Cited

U.S. PATENT DOCUMENTS

| | | | |
|---|---|---|---|
| 2,576,471 | 11/1951 | Messmer et al. | 226/56 |
| 2,712,210 | 7/1955 | Sawyer et al. | 53/26 |
| 2,751,965 | 6/1956 | Miller | 53/76 |
| 2,925,695 | 2/1960 | Fry | 53/45 |
| 2,925,699 | 2/1960 | Ozor | 53/371 |
| 3,115,736 | 12/1963 | Peterson | 53/371 |
| 3,241,290 | 3/1966 | Ingleson et al. | 53/76 X |
| 3,955,338 | 5/1976 | Winzeler et al. | 53/180 R |
| 4,162,602 | 7/1979 | Achelpohl et al. | 53/415 |
| 4,214,417 | 2/1980 | Lieder | 53/371 |
| 4,249,361 | 2/1981 | Tetenborg et al. | 53/415 |
| 4,574,560 | 3/1985 | Tetenborg et al. | 53/373 |
| 4,580,391 | 4/1985 | Tetenborg et al. | 53/371 |
| 4,704,845 | 11/1987 | Bruno | 53/481 X |

*Primary Examiner*—James F. Coan

*Attorney, Agent, or Firm*—Kirkland & Ellis

[57] ABSTRACT

There is provided a method and an apparatus for forming the tops of material-filled bags into substantially fin-like shapes suitable for sealing in conventional top-sealing machines. The filled bags may be conveyed at random to a top-forming location in the apparatus where a bag is stopped, a device such as a pair of hinged plates is inserted into the top of the bag, front and back forming plates and side gusseting blades simultaneously engage the outside of the bag, forming the top into a fin-shape, the blades and plates are withdrawn, and the bag is then conveyed from the top-forming location. Bag tops are formed more consistently and with excess air expelled with the present method and apparatus.

16 Claims, 9 Drawing Sheets

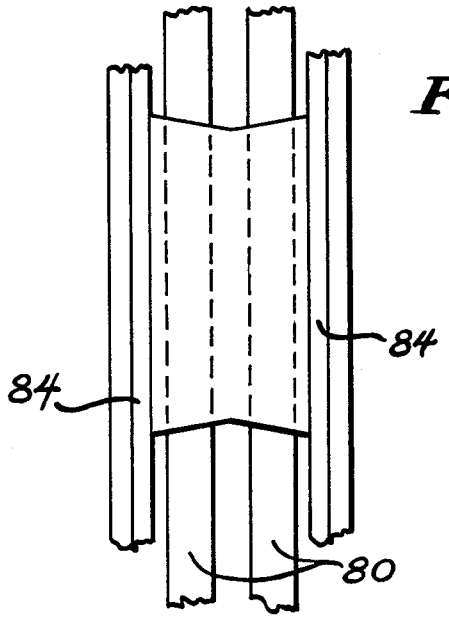
FIG. 7b
FIG. 7a
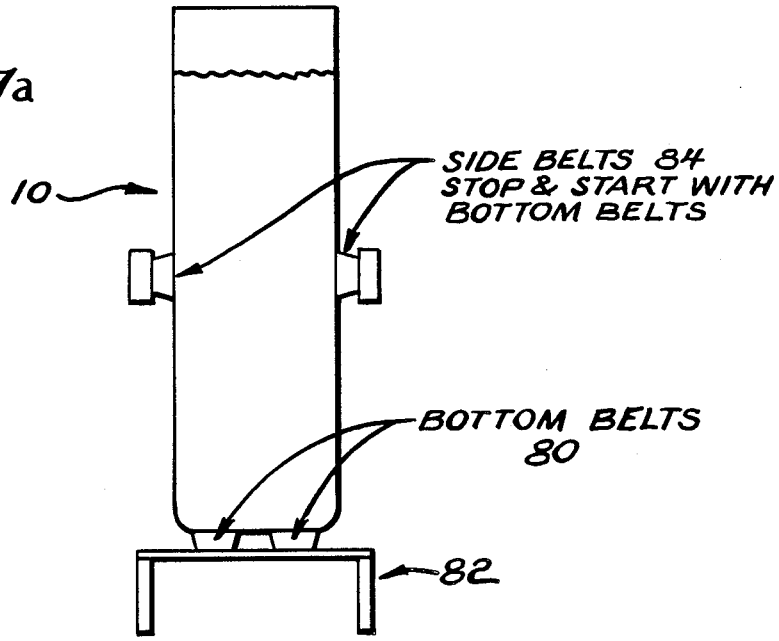

BAG TOP FORMING METHOD AND APPARATUS

BACKGROUND OF THE DISCLOSURE

1. Field of the Invention

The present invention relates to methods and apparatus for forming the tops of filled bags before the bags enter a top-sealing machine.

2. Description of the Related Art

In packaging a wide variety of materials such as pet foods and other feed-stuffs, coffee, yeast, cement, charcoal, fertilizers and other chemicals, non-rigid bags of paper or plastic conventionally are transported through one or more machines which fill the empty bags with desired amounts of materials and seal the tops of the bags after each is filled. It should be noted that "filled" merely means that each bag is loaded to a level which leaves enough bag material to be folded, closed and sealed so that the formerly open mouth of the bag is shut. As each bag is filled, the bag's walls spread apart and the bag is otherwise distorted, making it necessary to provide some means of forming the top of the bag into a flat shape which facilitates sealing in the top-sealing machine. This shape usually is obtained by tucking or gusseting the sides of the bag and bringing the front and back layers of the top together while expelling excess air remaining in the bag.

For most types of top-sealing machines, the filled bags must be presented at the entrance of the machine with the bag's top in the flat shape above-described so that the bag can be properly processed by the machine.

Several types of bag top sealing machines are in current use, including those which form heat-sealed top closures on plastic bags, taped and/or sewn top closures, and adhesive top closures. It is possible for the tops of filled bags to be shaped by hand, however, it is often more efficient to form the bag tops by machine. Examples of such bag-filling, top-forming and/or top-sealing machines are described in U.S. Pat. Nos. 2,576,471, 2,712,210, 2,925,695, 2,925,699 and 4,214,417. In general, the top-forming sections of these machines can be grouped in two classes, i.e., those which continuously grip the edges of a bag before, during and after the filling operation, and those which insert rods or fingers into the bag top and manipulate the sides and gussets of the top with shaped plates. These top-forming operations normally are carried out as the bags are continuously transported by means such as conveyor belts from the filling sections of the machines to the top-sealing sections. Nevertheless, none of these top-forming machines are capable of forming consistently shaped tops or handling filled bags which are randomly spaced on the conveyor.

Accordingly, it is an object of the present invention to provide a method and apparatus for forming a bag top which is properly shaped for sealing in a conventional top-sealing machine.

It is an additional object of the present invention to provide a method and apparatus for forming properly shaped tops on bags which are randomly positioned on means for transporting the bags through the apparatus.

It is a further object of the present invention to provide a method and apparatus for forming bag tops from which excess air has been expelled.

SUMMARY OF THE INVENTION

The above and other objects of the present invention are achieved by a method of forming bag tops which comprises the steps of (1) conveying a filled bag to a top-forming location, (2) sensing the bag's presence at that location, (3) stopping the bag when it is sensed at the location, (4) forming the top of the bag into a substantially fin-like shape, and (5) restarting the movement of the bag.

In another aspect f the present invention, the method further comprises the steps of centering and stabilizing the filled bag as it is conveyed, and repeating the steps of the method for each of a plurality of bags randomly positioned on the conveyor.

The present invention also comprehends a method in which the step of forming the bag's top into a substantially fin-like shape includes the steps of flattening the front and back of the bag top, simultaneously forcing the front and back together and forming side gussets, and expelling excess air from the bag.

The present invention also comprehends a method in which the conveying of the filled bag is restarted after a predetermined time period has elapsed or after the top of the bag has been formed.

An apparatus in accordance with the present invention comprises mean for conveying a filled bag to a top-forming location, means for sensing the presence of the bag at the top-forming location, means for stopping the conveying means when the bag's presence is sensed, means for forming the top of the bag into a substantially fin-like shape and means for restarting the conveying means.

In another aspect of the present invention, the apparatus may further comprise means for stabilizing and centering the filled bag on the conveying means. Also, the top-forming means can include means for flattening the front and back layers of the bag and means for forming inward gussets in the sides of the bag. The apparatus may further comprise timing means which is responsive to the sensing means or to the forming means.

BRIEF DESCRIPTION OF THE DRAWINGS

The above and other objects and advantages of the present invention may be understood best by studying the following detailed description, which description references the accompanying drawings, in which:

FIGS. 7*a* and 7*b* show side and top views of a portion of an apparatus in accordance with the present invention;

DETAILED DESCRIPTION

Figure 1:
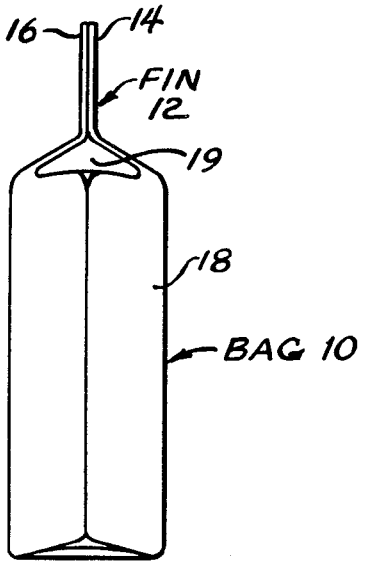
FIG. 1 PRIOR ART
FIG. 1 shows a side view of a filled bag having a top shaped by the method and apparatus of the present invention.

In operation, the present invention provides an apparatus in which filled bags are transported through the apparatus on a conventional conveyor belt or other suitable means at high speeds, for example, thirty to seventy feet per minute, preferably forty to sixty feet per minute. Otherwise conventional vertically oriented side belts may also be provided to center and stabilize the filled bags on the conveyor and the bags may be randomly located on the conveyor. As the bags are transported by the conveyor, a photo eye detects the presence of a bag at a top-forming location in the apparatus. This location generally is directly below a top-forming assembly comprising front and back flexible plates, although it may be laterally displaced somewhat to compensate for any inherent inertial or time delays in the apparatus. Upon detection of the presence of the bag at the top-forming location, a solenoid-operated, pneumatic valve is activated that causes the top-forming assembly to begin moving into the bag. As the assembly moves from its uppermost position, a suitable first switch is deactivated, causing a second solenoid-operated, pneumatic valve to activate a pneumatic clutch which stops the conveyor, thereby holding the bag at the top-forming location. Stopping the bag in this way results in formation of a better, more consistent top because the bag is properly positioned with respect to the top-forming means throughout the top-forming cycle.

As the top-forming assembly moves from its uppermost position, an electrical timer is activated which counts a predetermined, adjustable time interval, at the end of which the top-forming assembly is withdrawn from the bag top. During that time interval, the top-forming assembly is lowered into the bag until it activates a second switch which activates a third solenoid-operated, pneumatic valve and a second timer. Activation of the third solenoid-operated valve causes a pair of non-rotating, spring-return cylinders to extend front and back forming plates into engagement with the bag simultaneously with causing a pair of non-rotating, spring-return cylinders to extend side gusset blades into engagement with the bag. The front and back forming plates and side gusset blades form the top of the bag against the top-forming assembly, flattening the front and back layers of the bag and forming the side gussets inward.

When the second timer times out, i.e., its predetermined time interval elapses, the third solenoid-operated pneumatic valve is deactivated, and the front and back forming plates and side gusset blades retract under the influence of the return springs in the respective cylinders. At this point the first timer times out, causing the first solenoid-operated, pneumatic valve to reverse and the top-forming assembly to be withdrawn from the top of the bag that has been formed into a substantially fin-like shape. When the top-forming assembly reaches its uppermost position, the first switch is activated, causing the second solenoid-operated, pneumatic valve to release the clutch, thereby permitting the conveyor to move the bag away from the top-forming location. When the bag leaves the top-forming location, the photoeye then resets in preparation for detecting the presence of a subsequent bag at the top-forming location.

Referring now to FIG. 1, the shape of the top of a filled bag 10 which is most easily accepted by conventional top-sealing machines is the substantially fin-like shape illustrated. The thin, vertical fin 12 is formed by collapsing gussets in the sides of the bag, thereby bringing the front 14 and back 16 layers of the filled bag 10 together, and expelling any excess air from the top of the bag, i.e., that portion of the bag above the filling. In FIG. 1, only one side 18 and gusset 19 of the bag 10 are shown, although the opposite side is substantially identical in character. In the prior top-forming machines, many bags would have the gussets formed outwardly of the centers of the bags, and otherwise inconsistent top shapes. These drawbacks are avoided in an apparatus and method in accordance with the present invention.

Figure 2A:
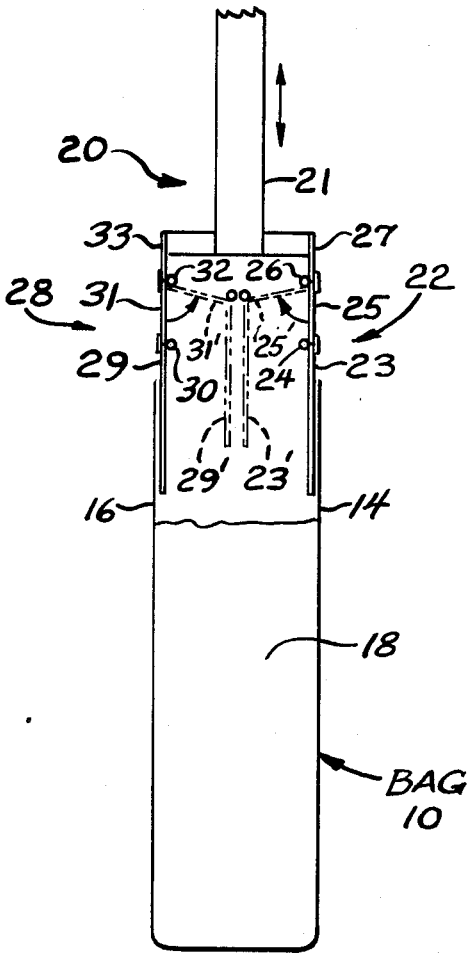
FIGS. 2*a* and 2*b* show views of a portion of a bag top forming apparatus in accordance with the present invention.
Figure 2B:
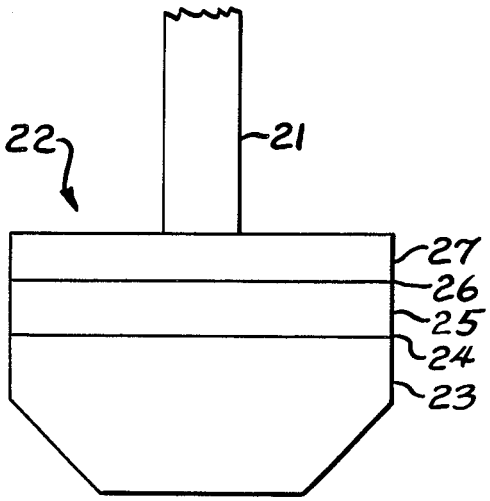

FIGS. 2*a* and 2*b* show side and front views respectively, of a portion of an apparatus in accordance with the invention. In FIG. 2*a*, a bag 10 is shown with a hinged plate top-forming assembly 20 positioned into the top of the bag. The top-forming assembly 20 is alternately inserted and extracted from the top of the bag 10 in the direction of the double-headed arrow by an otherwise conventional pneumatically or electrically driven apparatus (not shown) operating through a coupling member 21. Conventional bag top forming apparatus is manufactured by Bemis Co., Inc., Minneapolis, Minn. and Union Camp Corp., Lyndhurst, N.J.

Upon insertion into the top of the bag 10, front and back flexible plates 22 and 28 are fully extended and disposed relatively close together within the front 14 and back 16 layers of the filled bag 10. In one embodiment, the front flexible plate 22 comprises three sections 23, 25, 27 joined by two hinges 24 and 26 and the back flexible plate 28 similarly comprises three sections 29, 31, 33 joined by two hinges 30 and 32. The front and back flexible plates 22 and 28 insure that the bag shapes properly during formation of the top by folding sections 23, 25 and 29, 31 inwardly in the direction of the single-headed arrows shown to the positions identified with primed reference numerals.

The hinges 24, 26, 30, 32 in this embodiment are sufficiently flexible so that the front and back flexible plates 22 and 28 are normally fully extended as shown in FIG. 2*b*. The corners of front plate section 23 are advantageously beveled as shown or otherwise suitably contoured to facilitate proper entry of the plate 22 into the top of the bag 10. The corners of back plate section 29 are similarly shaped to facilitate entry into the top of the bag. In addition, both flexible plates 22 and 28 are disposed in parallel relatively close together, e.g., two to two and one-half inches apart, to facilitate their entry into the loose, open top of the bag 10.

Figure 3:
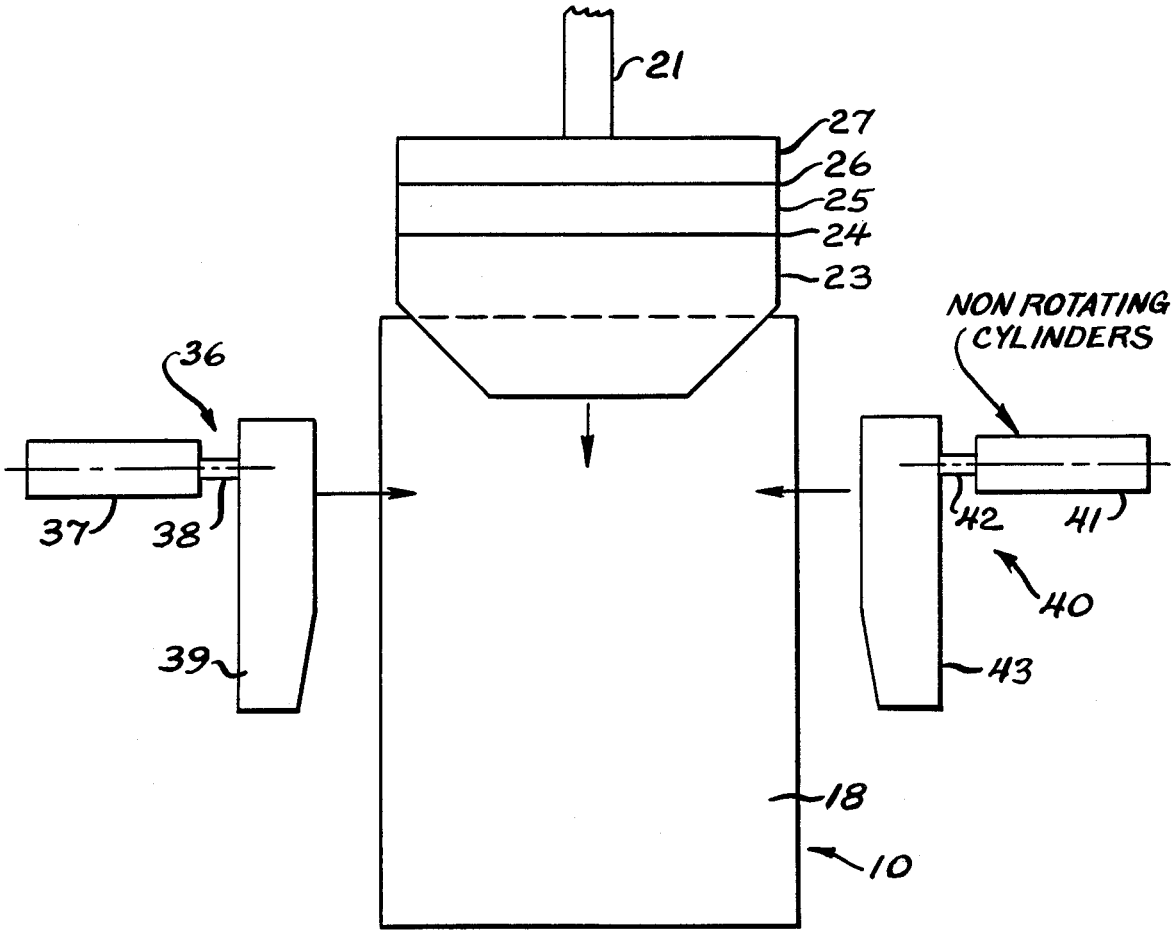
FIG. 3 shows a front view of a portion of the bag top forming apparatus in accordance with the present invention.

When the front and back flexible plates 22 and 28 have been lowered completely into the bag top by coupling member 21, a suitable switch is activated, as described in greater detail below, thereby activating a further portion of the apparatus shown in FIG. 3. Two gusset formers 36 and 40, shown in FIG. 3, comprise non-rotating, spring-return cylinders 37 and 41, which may be pneumatically or electrically activated, having extendable shafts 38 and 42 attached to gusset blades 39 and 43. When the front and back flexible plates are fully inserted into the bag 10, cylinders 37 and 41 are activated, moving gusset blades 39 and 43 in the direction of the arrows shown and thereby engaging the sides of the bag 10, forming gussets therein and pulling the loose bag top into contact with plate sections 23 and 29. The blades 39 and 43 may have cross-sections which are of either thin, substantially oblong shape or wedge shape, such shapes being suitable for forming gussets in the sides of the bag 10. As the looseness of the bag top is taken up and the plate sections 23 and 29 form the front and back of the bag top flat, the tucking of the gussets by the blades 39 and 43 further tightens the bag top, causing the flexible plates 22 and 28 to move inward and together, forming the fin-shaped top.

Figure 4A:
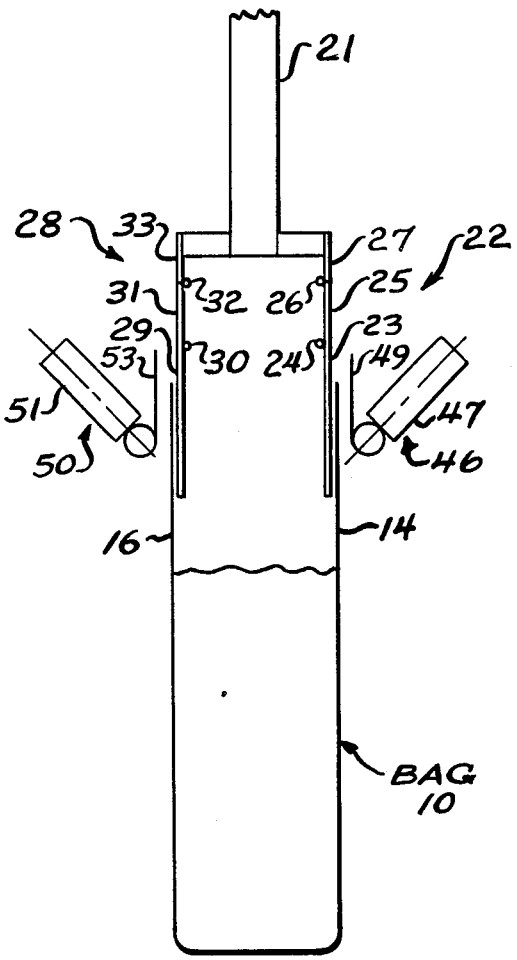
FIGS. 4*a* and 4*b* show side views of a portion of a bag top forming apparatus in accordance with the inventions.
Figure 4B:
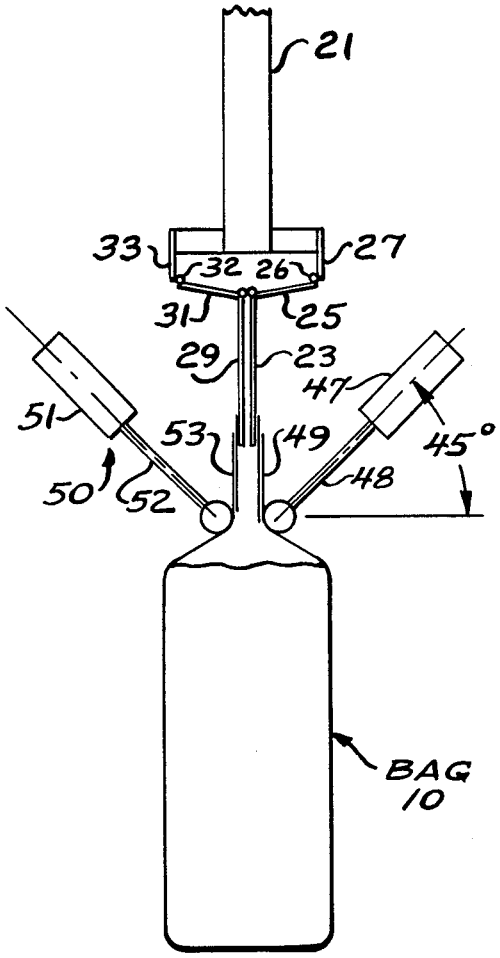

Also activated by insertion of the flexible plates into the bag top are front and back formers 46 and 50, respectively, shown in FIGS. 4*a* and 4*b*. In FIG. 4*a*, the front and back formers are shown just before the front and back flexible plates have been fully inserted into the bag 10. FIG. 4*b* shows the front 46 and back 50 formers, with their vertical plates 49 and 53, fully extended. It will be understood from FIG. 4*b* that as the formers are extended, they engage the front 14 and back 16 layers of the bag 10, pushing those layers together and helping to fold the front 22 and back 28 flexible plates to the positions shown. Simultaneously, any excess air in the top of the bag 10 is eliminated. Each former 46 and 50 advantageously comprises a non-rotating, spring-return cylinder 47 or 51 having an extendable shaft 48 or 52 that may be either pneumatically or electrically operated and that is oriented so that the attached vertical plate 49 or 53 is extended at an angle with respect to the bag suitable for collapsing the bag top. Such an angle may be forty-five degrees with respect to the horizontal as shown in FIG. 4*b*.

Figure 5:
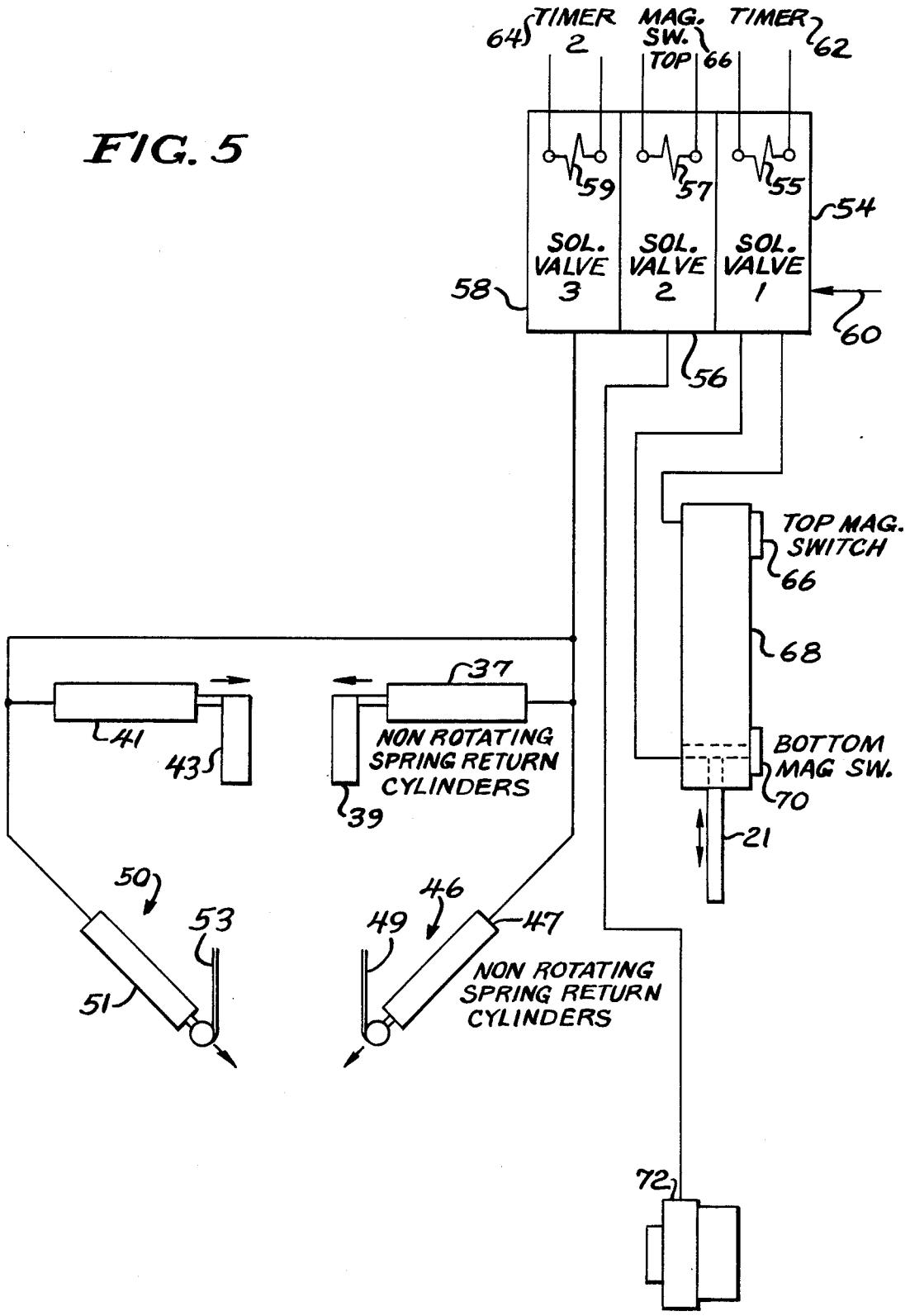
FIG. 5 shows a pneumatic schematic diagram of an apparatus in accordance with the present invention.
Figure 6:
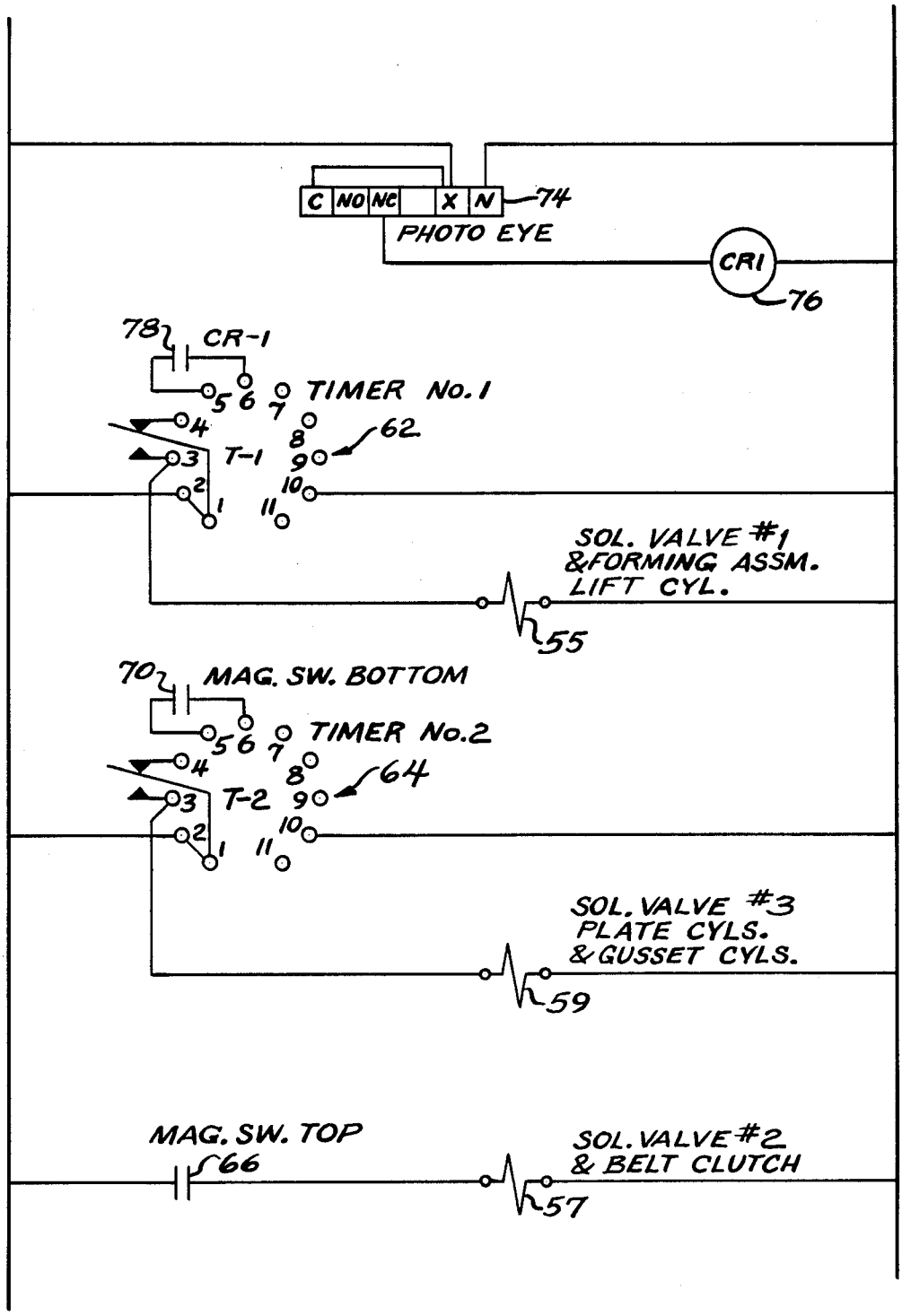
FIG. 6 shows a electrical schematic diagram of an apparatus in accordance with the present invention.

Referring now to FIGS. 5 and 6, there are shown respectively, pneumatic and electrical schematic diagrams of the apparatus in accordance with the present invention. FIG. 5 shows the first, second and third solenoid-operated valves 54, 56, 58, respectively, which are connected to a suitable source of pressurized gas or air 60 and to the first switch 66, and first and second timers 62 and 64 shown in FIG. 6. The solenoid coils 55, 57, 58 associated with first, second and third valves 54, 56, 58 are also indicated in FIGS. 5 and 6. As explained above, the first solenoid-operated valve 54 activates an otherwise conventional means 68 for inserting or withdrawing the top-forming assembly via the coupling member 21 in the direction of the double-headed arrow shown in FIG. 5. Also shown in FIG. 5 are the first switch 66 which is activated when the top-forming assembly is at its uppermost or fully withdrawn position and second switch 70 which is activated when the assembly is at its lowermost or fully inserted position. First and second switches 66 and 70 may be conventional magnetically actuated switches. As seen from the Figures, activation of the first switch 66 activates the second valve 56 causing clutch 72 to halt the bag conveyor.

In FIG. 6, the conventional photoeye 74 detects the presence of a bag at the top-forming location and deenergizes a suitable relay coil 76, closing relay contacts 78 which activate the first timer 62. At that point, the first timer 62, which can be any suitable electronic timer having an associated pair of switch contacts, energizes the solenoid 55 in the first valve 54, causing the top-forming assembly to begin to be inserted into the bag top. When the top-forming assembly is fully inserted, the second switch 70 is activated, in turn activating the second timer 64 which can be similar in most respects to the first timer 62. The activation of the second timer 64 energizes the solenoid 59 of the third valve 58, activating the front and back former assemblies 46 and 50.

Referring now to FIGS. 7*a* and 7*b*, there are shown side and top views, respectively, of means for conveying the bags through the apparatus in accordance with the present invention. The bag 10 is transported by suitable means such as a pair of bottom belts 80 which are a portion of an otherwise conventional conveyor 82. In addition, a pair of side belts 84 are disposed in contact with the bag 10 below the level of the material filling the bag to stabilize and center the bag on the bottom belts 80. The side belts 84 are arranged such that their motion starts and stops with the motion of the bottom belts 80 that is selectively controlled by the pneumatic clutch 72.

Figure 8A:
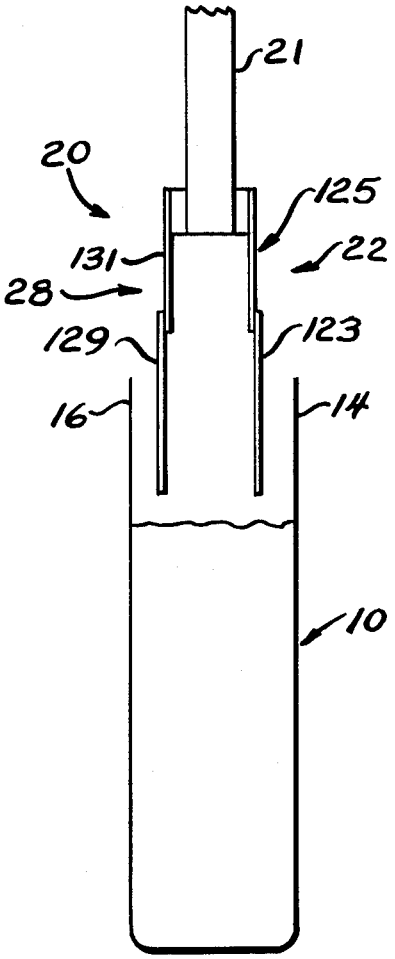
FIGS. 8*a* and 8*b* show side and front views of another embodiment of the portion of the apparatus of FIGS. 2*a* and 2*b.
Figure 8B:
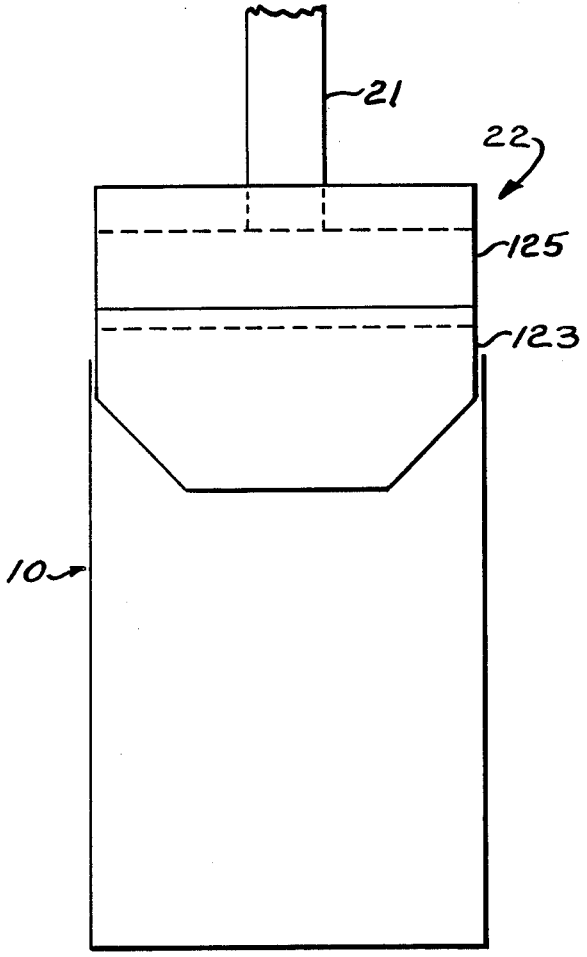
Figure 9B:
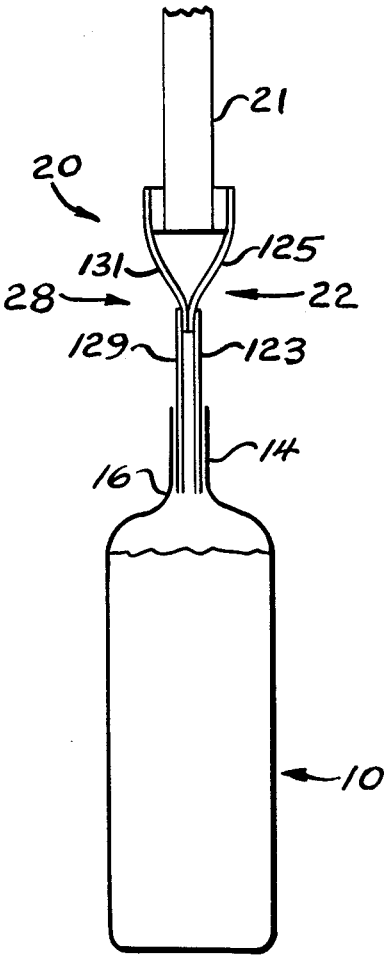
* and FIGS. 9*a* and 9*b* show additional views of the embodiment of FIGS. 8*a* and 8*b*.
Figure 9A:
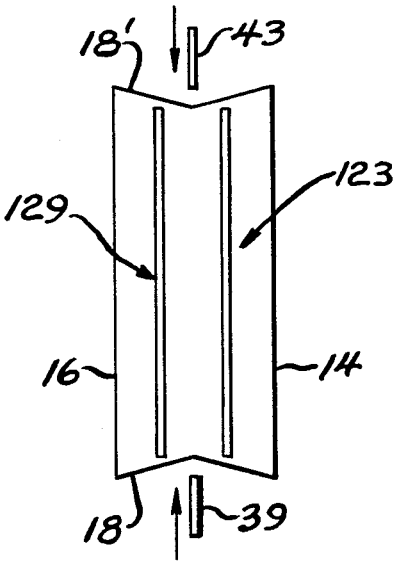

In an alternative embodiment of the present invention shown in FIGS. 8*a* and 8*b*, the top forming assembly 20 can include front and back flexible plates 22 and 28, respectively, each comprising a plate section 123 or 129 joined to the coupling member 21 by flexure sections 125 or 131, respectively. The plate sections 123, 129 may be sheet metal or other suitably stiff material and the flexure sections 125 and 131 can be comprised of flexible belting, rubber, or other suitably flexible material. When the top forming assembly 20 is lowered into the loose top of the bag as shown in FIG. 9*a*, gusset blades 39 and 43 engage the sides 18' and 18 of the bag, drawing the material of the bag top tighter around the top forming assembly. As a result, the flexure sections 125 and 131 are bent, pulling the plate sections 123 and 129 inwardly to form the fin-shaped bag top, as shown in FIG. 9*b*. Operation of the bag top forming apparatus including the flexure-plate assemblies 123, 125 and 129, 131 is the same in other respects as the operation of the apparatus including the hinged plate assemblies 23–27 and 29–33.

It should be noted that the above description and drawings are illustrative only, as one of ordinary skill in the art would recognize that various modifications could be made without departing from the spirit or scope of the present invention, which is to be limited only by the following claims.

What is claimed is:

1. An apparatus for forming a top of a bag filled with a material, comprising:

means for conveying the filled bag to a forming location;

means for sensing when the filled bag is present at the forming location;

means for stopping the conveying means, the stopping means being responsive to the sensing means and being releasable;

means for forming the top of the filled bag into a substantially fin-like shape while the bag is stopped at the forming locations; and means for releasing the stopping means when the top has been formed into the substantially fin-like shape;

wherein the means for forming the top of the filled bag includes front and back flexible plates for flattening a front layer and a back layer of the bag.

2. The apparatus of claim 1, further comprising means for stabilizing and centering the filled bag on the conveying means.

3. The apparatus of claim 1, wherein the means for forming the top of the filled bag includes means for forming gussets inwardly of opposite sides of the bag.

4. The apparatus of claim 3, wherein the front and back flexible plates are hinged plates cooperatively associated with front and back formers.

5. The apparatus of claim 3, wherein the front and back flexible plates each comprise a plate section and a flexure section.

6. The apparatus of claim 1, further comprising first means for timing a first predetermined, adjustable time interval, the first timing means being responsive to the sensing means.

7. The apparatus of claim 6, further comprising second means for timing a second predetermined, adjustable, time interval, the second timing means being responsive to the forming means.

8. The apparatus of claim 1, wherein the stopping means is a pneumatic clutch.

9. The apparatus of claim 1, wherein the conveying means conveys a plurality of filled bags to the forming location, the bags being randomly located on the conveying means and simply arriving at the forming location.

10. A method for forming a top of a bag filled with a material, comprising:

conveying a filled bag to a forming location;

sensing when the filled bag is present at the forming location;

stopping the bag at the forming location;

forming the top of the bag into a substantially fin-like shape while the bag is stopped; and conveying the bag from the forming location after the top has been formed into the substantially fin-like shape;

wherein the top forming step includes the step of flattening a front layer and a back layer of the bag by inserting front and back flexible plates into the top of the bag.

11. The method of claim 10, further comprising the steps of stabilizing and centering the bag while the bag is being conveyed to the forming location.

12. The method of claim 10, wherein the top forming step includes the step of simultaneously forming inwardly directed gussets in opposite sides of the bag by pushing the front and back layers of the bag together.

13. The method of claim 10, wherein the front and back flexible plates are hinged plates.

14. The method of claim 10, wherein the front and back flexible plates each have a plate section and a flexure section.

15. The method of claim 10, further comprising the step of timing a front predetermined, adjustable, interval, wherein the top forming step is carried out during the first interval.

16. The method of claim 10, further comprising the step of repeating the method for each of a plurality of filled bags randomly conveyed singly to the forming location.

* * * * *

UNITED STATES PATENT AND TRADEMARK OFFICE

CERTIFICATE OF CORRECTION

PATENT NO. : 4,872,303

DATED : October 10, 1989

INVENTOR(S) : Harold K. Johnson

It is certified that error appears in the above-identified patent and that said Letters Patent is hereby corrected as shown below:

| | |
|---|---|
| Column 2, line 7 | "f" should be --of-- |
| Column 2, line 23 | "mean" should be --means-- |
| Column 2, line 59 | "a" should be --an-- |
| Column 3, line 12 | "photo eye" should be --photoeye-- |
| Column 5, line 36 | "55, 57, 58" should be --55, 57, 59-- |

Signed and Sealed this

Twenty-fifth Day of September, 199(

*Attest:*

HARRY F. MANBECK, JR.

*Attesting Officer*

*Commissioner of Patents and Trademarks*